US010208388B2

(12) United States Patent
Hatano et al.

(10) Patent No.: US 10,208,388 B2
(45) Date of Patent: Feb. 19, 2019

(54) ION EXCHANGE MEMBRANE ELECTROLYZER AND ELASTIC BODY

(71) Applicant: OSAKA SODA CO., LTD., Osaka-shi (JP)

(72) Inventors: Satoshi Hatano, Osaka (JP); Manabu Nagase, Osaka (JP); Li Weitao, Osaka (JP)

(73) Assignee: Osaka Soda Co., Ltd., Osaka-shi, Osaka (JP)

( * ) Notice: Subject to any disclaimer, the term of this patent is extended or adjusted under 35 U.S.C. 154(b) by 137 days.

(21) Appl. No.: 14/916,974

(22) PCT Filed: Oct. 23, 2014

(86) PCT No.: PCT/JP2014/078167
§ 371 (c)(1),
(2) Date: Mar. 4, 2016

(87) PCT Pub. No.: WO2015/068579
PCT Pub. Date: May 14, 2015

(65) Prior Publication Data

US 2016/0237577 A1 Aug. 18, 2016

(30) Foreign Application Priority Data

Nov. 6, 2013 (JP) ..... 2013-230107

(51) Int. Cl.
*C25B 9/10* (2006.01)
*C25B 9/20* (2006.01)

(52) U.S. Cl.
CPC ..... *C25B 9/10* (2013.01); *C25B 9/20* (2013.01); *C25B 9/206* (2013.01)

(58) Field of Classification Search
CPC ..... C25B 9/10; C25B 9/20; C25B 9/206
See application file for complete search history.

(56) References Cited

U.S. PATENT DOCUMENTS 5,360,526 A 11/1994 Arimoto et al.
2003/0188966 A1 10/2003 Katayama
(Continued)

FOREIGN PATENT DOCUMENTS

CN 101220482 A 7/2008
CN 202072770 U 12/2011
(Continued)

OTHER PUBLICATIONS

Extended European Search Report for PCT Application No. PCT/JP2014078167 dated Aug. 8, 2016.
(Continued)

*Primary Examiner* — Ciel P Thomas
(74) *Attorney, Agent, or Firm* — Knobbe, Martens, Olson & Bear, LLP

(57) ABSTRACT

An ion exchange membrane electrolyzer includes an elastic body configured to press on a second electrode so as to bring an ion exchange membrane into close contact with electrodes. The elastic body includes a fixed part fixed to one of a base part and the second electrode, and an elastic part that extends from the fixed part, and is configured to press on the second electrode by elastic deformation. The elastic part is formed so as to be plate-like and formed so as to be corrugated along a direction in which it extends, such that a top part on one side is in contact with the base part and a top part on the other side is in contact with the second electrode.

6 Claims, 12 Drawing Sheets

(56) References Cited

U.S. PATENT DOCUMENTS

| | | | |
|---|---|---|---|
| 2006/0042935 | A1 | 3/2006 | Houda et al. |
| 2007/0278095 | A1 | 12/2007 | Asaumi |
| 2008/0053821 | A1 | 3/2008 | Suzuki et al. |
| 2015/0299876 | A1 | 10/2015 | Hara et al. |

FOREIGN PATENT DOCUMENTS

| | | | |
|---|---|---|---|
| CN | 104769162 | A | 7/2015 |
| EP | 1 338 681 | A2 | 8/2003 |
| EP | 1 338 681 | A3 | 10/2003 |
| JP | 5-306484 | A | 11/1993 |
| JP | 2000-178781 | A | 6/2000 |
| JP | 2004-002993 | A | 1/2004 |
| JP | 3686270 | B | 6/2005 |
| JP | 2007-321229 | A | 12/2007 |
| JP | 2008-063611 | A | 3/2008 |
| JP | 2012-180537 | A | 9/2012 |
| JP | 2012-193437 | A | 10/2012 |
| WO | 2010/122785 | A1 | 10/2010 |
| WO | 2014/069360 | A1 | 8/2014 |

OTHER PUBLICATIONS

Office Action dated May 12, 2017 in corresponding CN Application No. 201480049705.0.

Chinese Office Action for Chinese Patent Application No. 201480049705.0 with English Translation in 11 pages.

3rd Chinese Office Action for Application No. 201480049705.0 dated May 31, 2018 in 12 pages (translation provided).

Japanese Notice of Reasons for Refusal for Application No. 2015-546596 dated Jun. 1, 2018 in 7 pages (translation provided).

Chinese Office Action for Chinese Application No. 201480049705.0, dated Nov. 20, 2018, in 4 pages (English translation included).

ION EXCHANGE MEMBRANE ELECTROLYZER AND ELASTIC BODY

CROSS-REFERENCE TO RELATED APPLICATIONS

This application is the U.S. National Phase under 35. U.S.C. § 371 of International Application PCT/JP2014/078167, filed Oct. 23, 2014, which claims priority to Japanese Patent Application No. 2013-230107, filed Nov. 6, 2013. The disclosures of the above-described applications are hereby incorporated by reference in their entirety.

TECHNICAL FIELD

The present invention relates to an ion exchange membrane electrolyzer placing an ion exchange membrane between a first electrode and a second electrode. The present invention also relates to an elastic body that is disposed in an elastically deformable manner, in the ion exchange membrane electrolyzer, between a base part fixed with respect to and spaced from the first electrode and the second electrode, the ion exchange membrane is brought into close contact with the electrodes by the elastic body pressing on the second electrode.

BACKGROUND ART

Conventionally, there is known an ion exchange membrane electrolyzer in which an anode, an ion exchange membrane, a cathode, an elastic body, and a base part are arranged in the stated order (e.g., Patent Documents 1 and 2). In such an ion exchange membrane electrolyzer, the elastic body includes a fixed part fixed to the base part, and a leaf spring extending at an angle from the fixed part. Then, pressing of the cathode by the elastically deforming leaf spring brings the ion exchange membrane into close contact respectively with the anode and the cathode.

In the meantime, the elastic body according to Patent Documents 1 and 2 is configured such that a force of the leaf spring to press on the cathode increases as a distance between the cathode and the base part. Therefore, if the distance between the cathode and the base part is small due to an error in design or in production, for example, there is a case in which the electrodes and the ion exchange membrane may not be brought into close contact with each other by a generally uniform force as the leaf spring locally presses on the cathode. In addition, the leaf spring may possibly damage the cathode.

PRIOR ART DOCUMENTS

Patent Documents

Patent Document 1: JP-A-2004-2993
Patent Document 2: JP-A-2008-63611

SUMMARY OF THE INVENTION

Problems to be Solved by the Invention

Thus, in view of the above circumstances, an object of the present invention is to provide an ion exchange membrane electrolyzer and an elastic body, with which electrodes and an ion exchange membrane may be brought into close contact with each other by a generally uniform force.

Means for Solving the Problems

According to the present invention, there is provided an ion exchange membrane electrolyzer, which includes:

a first electrode;

a base part fixed with respect to and spaced from the first electrode;

a second electrode disposed between the first electrode and the base part;

an ion exchange membrane disposed between the first electrode and the second electrode; and an elastic body disposed between the base part and the second electrode in an elastically deformable manner, and configured to press on the second electrode so as to bring the ion exchange membrane into close contact with the electrodes, wherein the elastic body includes: a fixed part fixed to one of the base part and the second electrode; and an elastic part that extends from the fixed part, and is configured to press on the second electrode by elastic deformation, and the elastic part is formed so as to be plate-like and formed so as to be corrugated along a direction in which it extends, such that a top part on one side is in contact with the base part and a top part on the other side is in contact with the second electrode.

According to the ion exchange membrane electrolyzer of the present invention, the elastic body disposed between the base part and the second electrode is fixed to one of the base part and the second electrode by the fixed part. Further, the elastic part extending from the fixed part is formed so as to be plate-like, and formed so as to be corrugated along direction in which it extends. Moreover, the top part on one side of the elastic part is brought into contact with the base part, and the top part on the other side of the elastic part is brought into contact with the second electrode. With this, as the elastically deforming elastic part presses on the second electrode, the ion exchange membrane is brought into close contact respectively with the electrodes.

At this time, the elastic part formed so as to be corrugated is elastically deformed so as to extend in the direction in which the elastic part extends according to the distance between the second electrode and the base part. Specifically, the elastic part elastically deforms such that the distance between the top parts in the direction of extension increases, and such that the distance between the top part on one side and the top part on the other side in a direction perpendicular to the direction of extension (direction in which the second electrode faces the base part) decreases. Therefore, as it is possible to prevent the elastic part from pressing on the second electrode locally, the electrodes may be brought into close contact with the ion exchange membrane by a generally uniform force.

Also, the ion exchange membrane electrolyzer may have a configuration in which:

at least one of the top parts on one side and the other side of the elastic part is formed in a curved shape.

According to this configuration, as the top part on one side of the elastic part in contact with the base part and (or) the top part on the other side of the elastic part in contact with the second electrode are (is) formed in a curved shape, the elastic part is able to elastically deform so as to easily extend in the direction of extension according to the distance between the second electrode and the base part. Therefore, the electrodes may be brought into close contact with the ion exchange membrane by a generally uniform force.

Also, the ion exchange membrane electrolyzer may have a configuration in which:

at least one of the top parts on one side and the other side of the elastic part is formed in a planar shape.

According to this configuration, as the top part on one side of the elastic part in contact with the base part and (or) the top part on the other side of the elastic part in contact with the second electrode are (is) formed in a planar shape, the elastic part may be brought into contact with the base part and (or) the second electrode with a uniform force by the top part(s). Therefore, the electrodes may be brought into close contact with the ion exchange membrane by a generally uniform force.

Also, the ion exchange membrane electrolyzer may have a configuration in which:

the fixed part is formed in an elongated shape, and a plurality of elastic parts is disposed so as to extend from both sides of the fixed part in the crosswise direction.

According to this configuration, the plurality of elastic parts is disposed so as to extend from the both sides of the fixed part in the crosswise direction. With this, the plurality of elastic parts may elastically deform uniformly when the elastic parts elastically deform according to the distance between the second electrode and the base part. Therefore, the electrodes may be brought into close contact with the ion exchange membrane by a generally uniform force.

According to the present invention, there is provided in the context of an ion exchange membrane electrolyzer, an elastic body that is disposed in an elastically deformable manner between a base part, which is fixed with respect to and spaced from a first electrode, and a second electrode, which is disposed between the first electrode and the base part, an ion exchange membrane being disposed between the first electrode and the second electrode, and that is configured to press on the second electrode so as to bring the ion exchange membrane into close contact with the electrodes, the elastic body comprising:

a fixed part fixed to one of the base part and the second electrode; and an elastic part that extends from the fixed part, and is configured to press on the second electrode by elastic deformation, wherein the elastic part is formed so as to be plate-like and formed so as to be corrugated along a direction in which it extends, such that a top part on one side is in contact with the base part and a top part on the other side is in contact with the second electrode.

Effect of the Invention

As described above, the present invention has an advantageous effect of bringing electrodes and an ion exchange membrane into close contact with each other by a generally uniform force.

MODE FOR CARRYING OUT THE INVENTION

Figure 1:
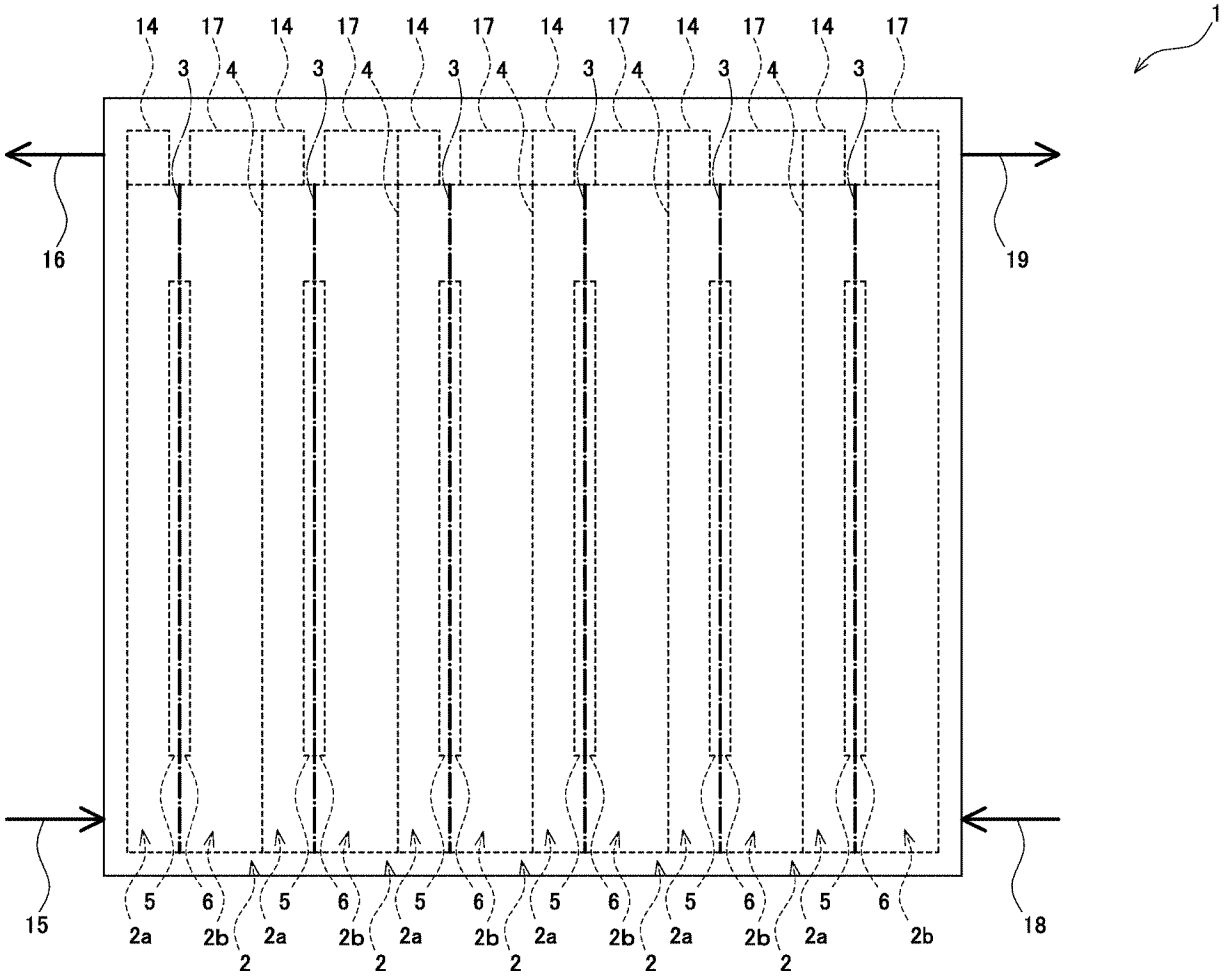
FIG. 1 is an overall front view of an ion exchange membrane electrolyzer according to one embodiment.

Hereinafter, one embodiment of an ion exchange membrane electrolyzer will be described with reference to FIG. 1 through FIG. 12. Here, a dimensional ratio in the drawings does not necessarily correspond to a real dimensional ratio.

Figure 2:
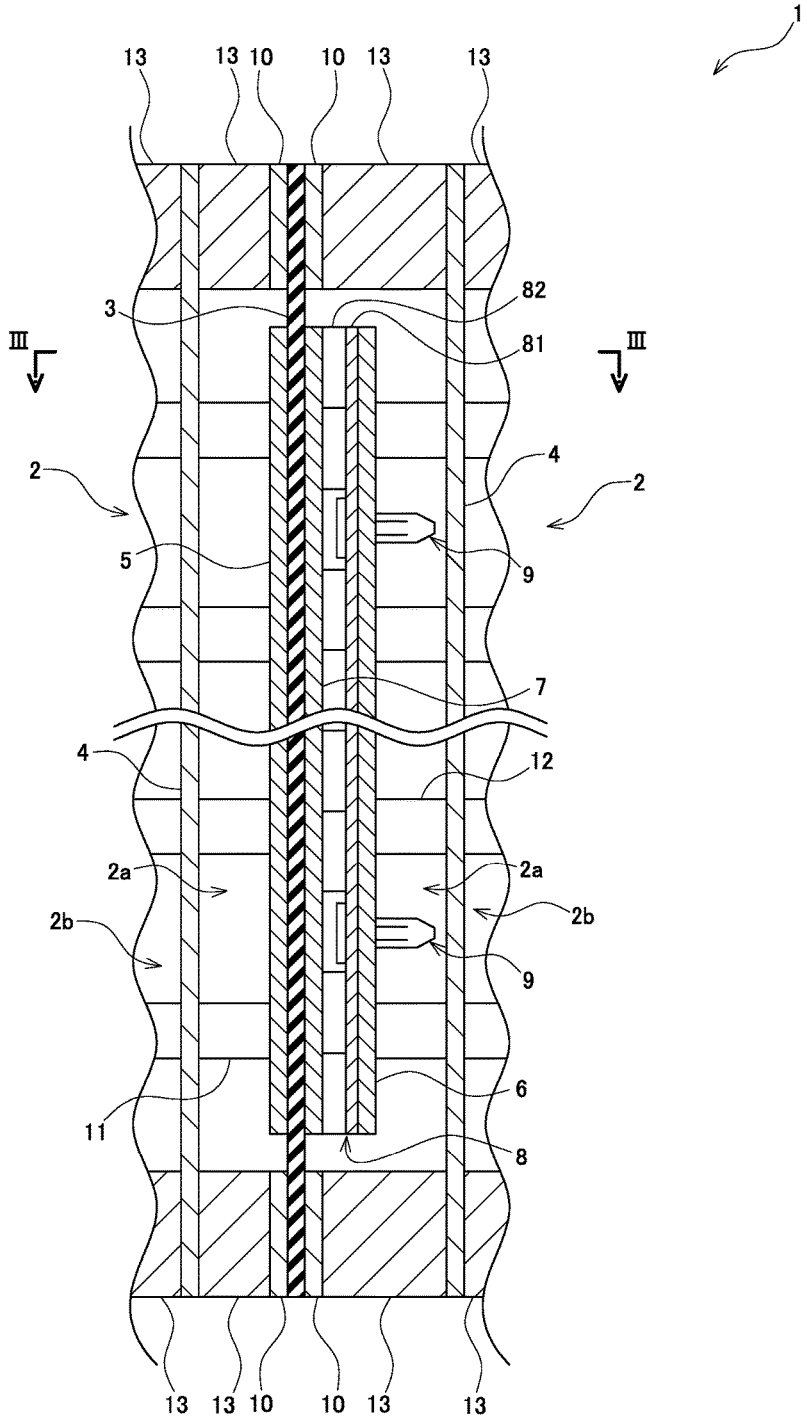
FIG. 2 is a vertical sectional view of a main part in the front view of the ion exchange membrane electrolyzer according to this embodiment.
Figure 3:
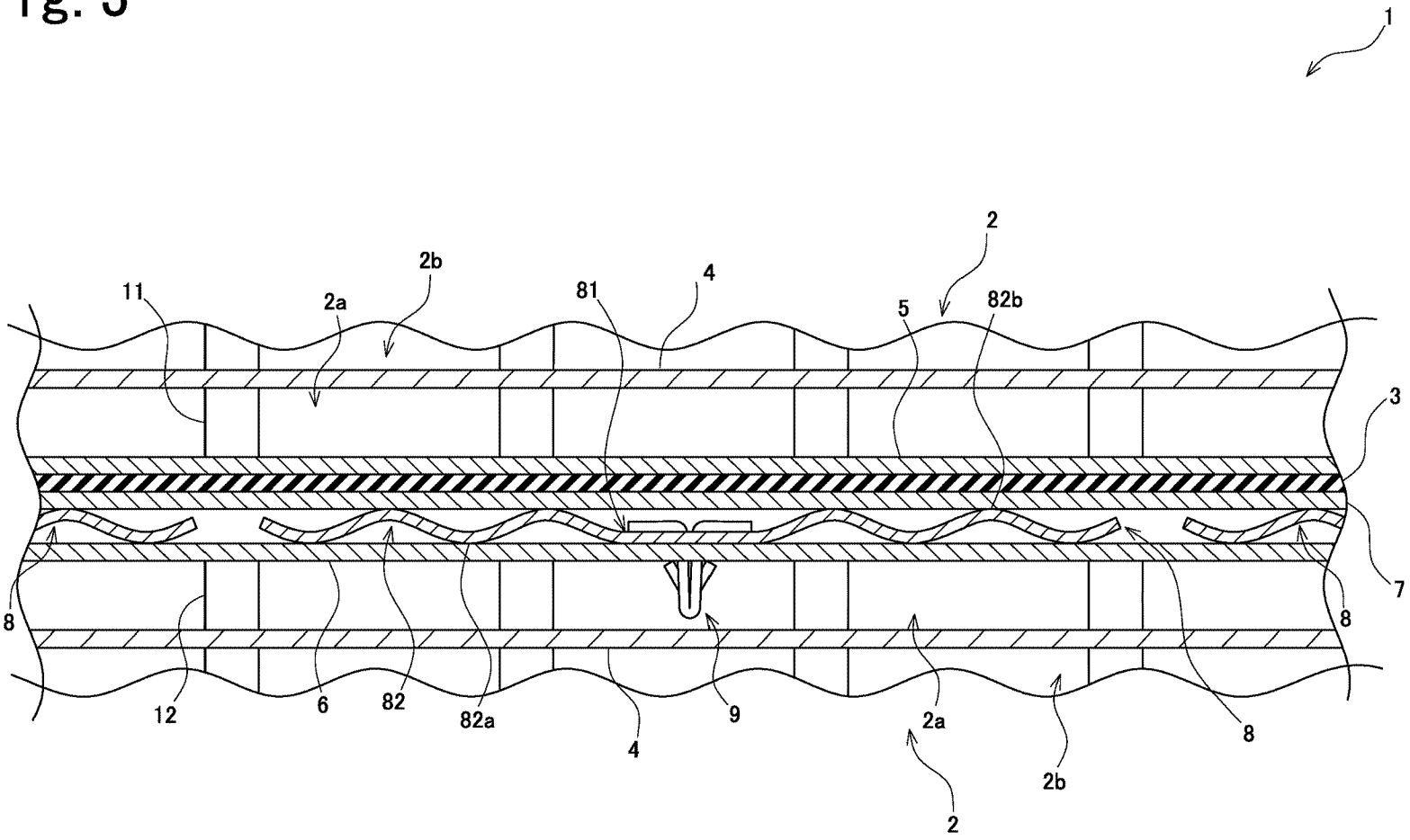
FIG. 3 is a sectional view of a main part of the ion exchange membrane electrolyzer according to this embodiment, taken along line III-III in FIG. 2.
Figure 4:
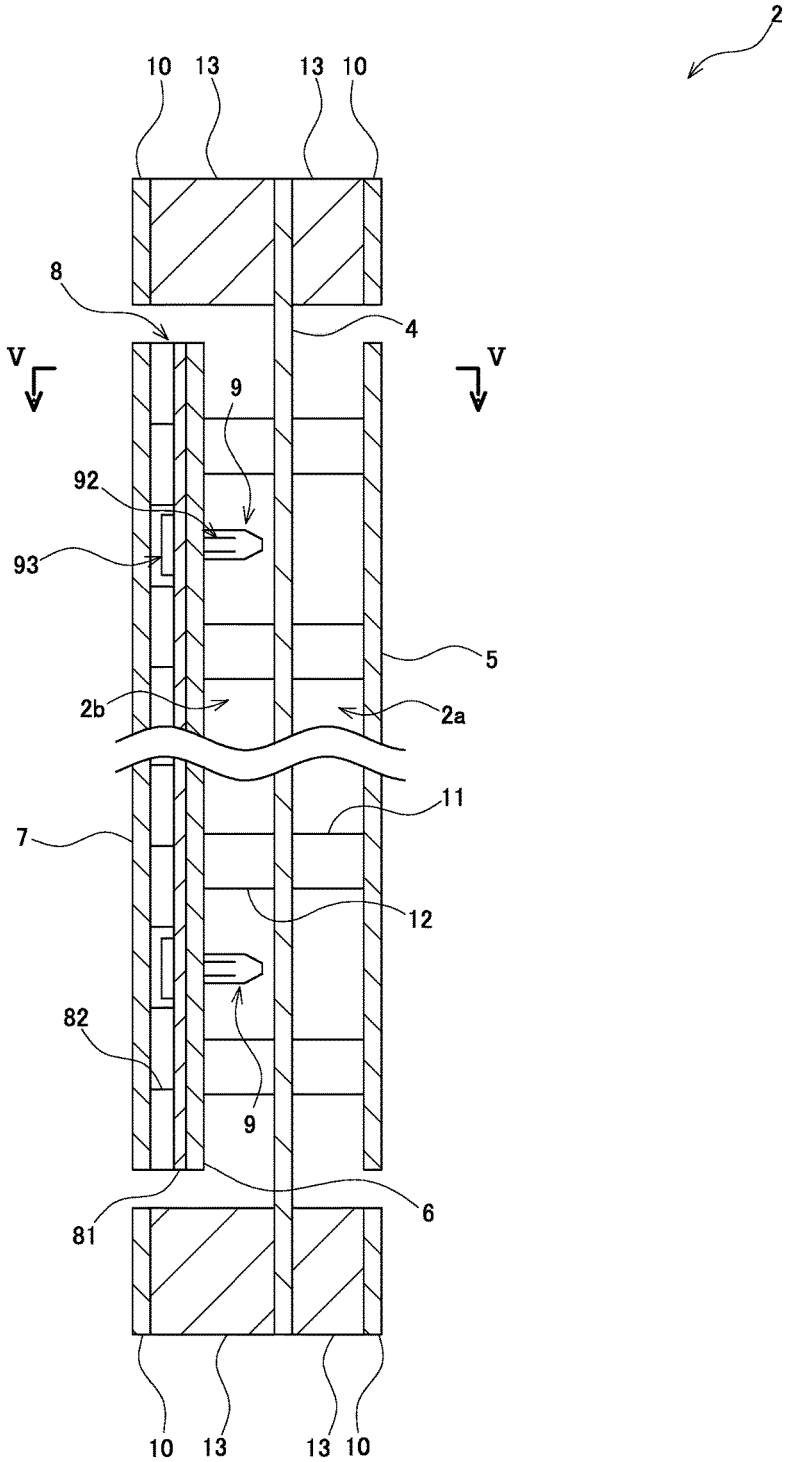
FIG. 4 is a vertical sectional view of a main part in the front view of an electrolyzer unit according to this embodiment.
Figure 5:
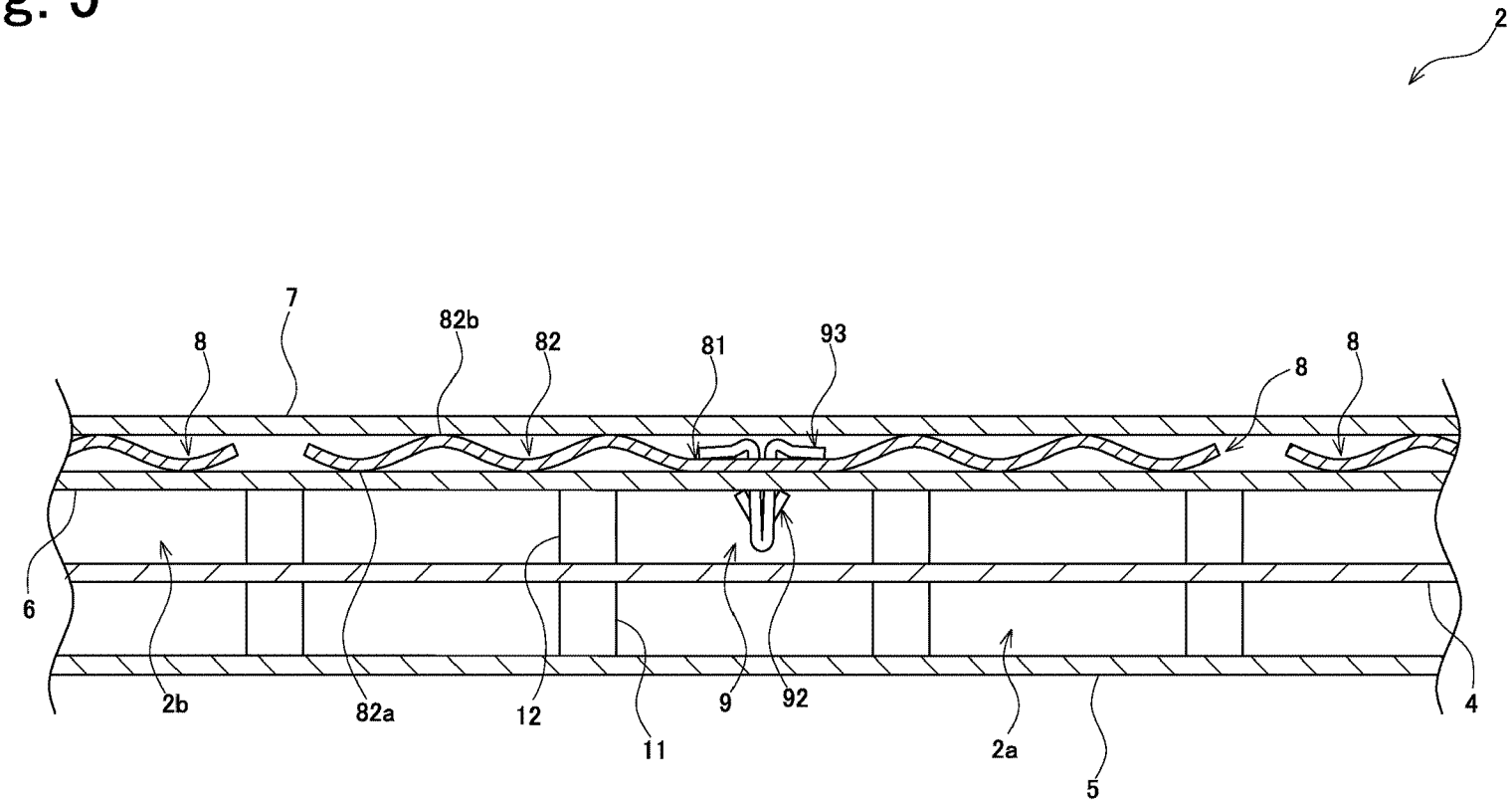
FIG. 5 is a sectional view of a main part of the electrolyzer unit according to this embodiment, taken along line V-V in FIG. 4.
Figure 6:
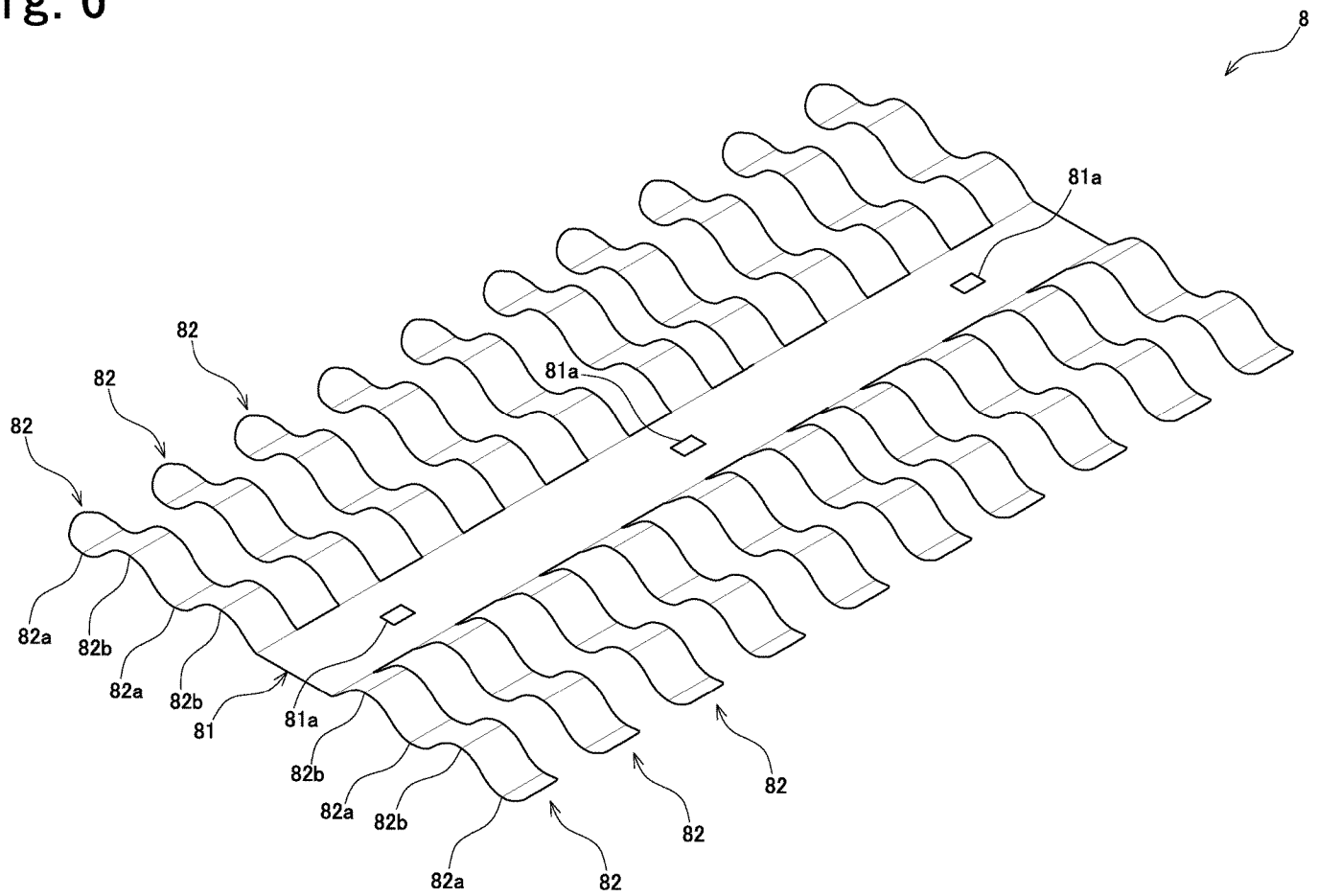
FIG. 6 is an overall perspective view of an elastic body according to this embodiment.
Figure 7:
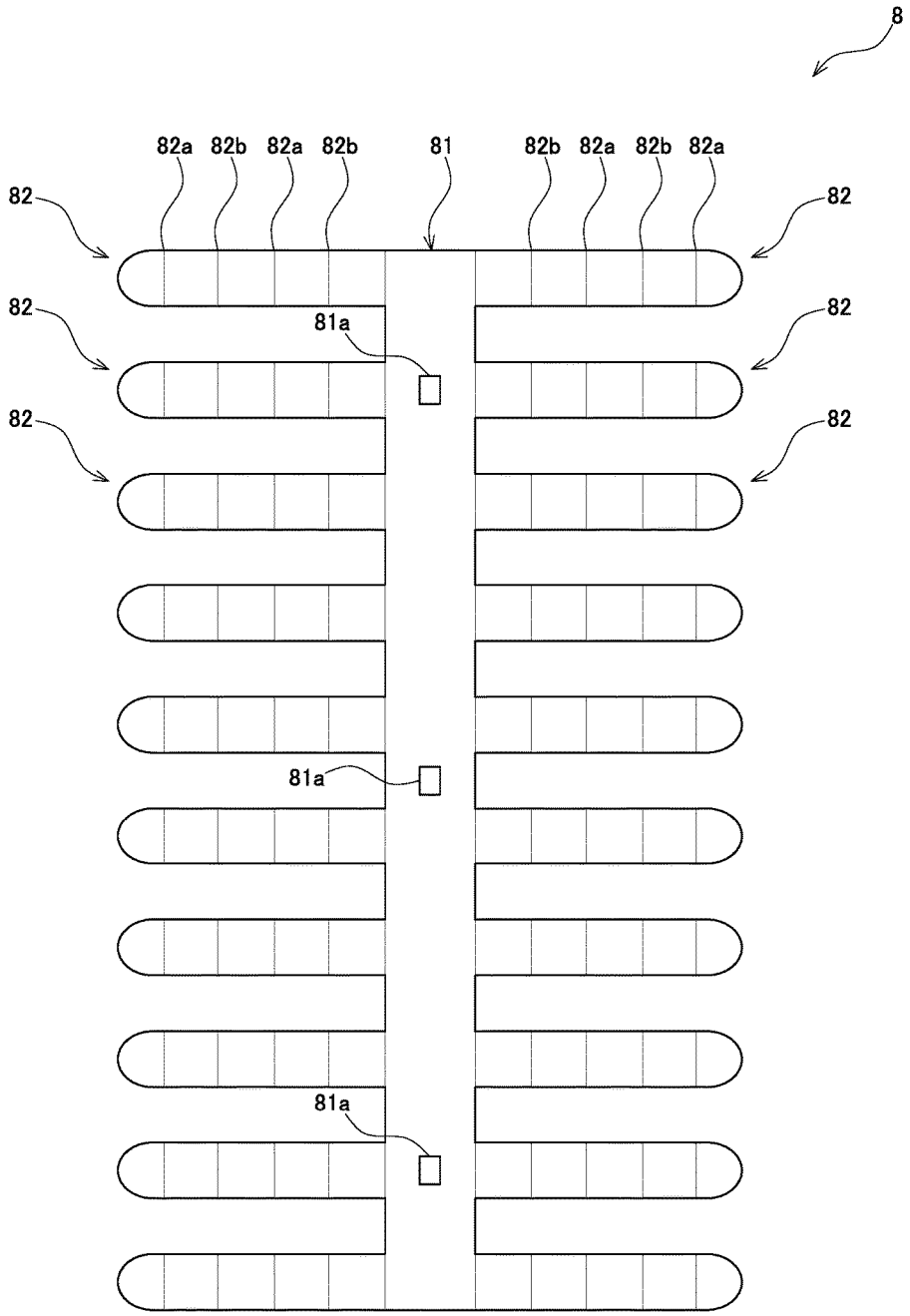
FIG. 7 is an overall front view of an elastic body according to this embodiment.

Referring to FIG. 1 through FIG. 3, an ion exchange membrane electrolyzer 1 according to this embodiment includes a plurality of electrolyzer units 2 that are stacked, ion exchange membranes 3 each disposed between adjacent ones of the electrolyzer units 2, 2. As used herein, the electrolyzer units 2 according to this embodiment are a bipolar-type electrolyzer unit having an anode chamber 2*a* and a cathode chamber 2*b*.

The ion exchange membrane electrolyzer 1 includes anode chamber side vapor-liquid separator parts 14 disposed on the respective anode chambers 2*a*, an anolyte supply part 15 for supplying anolyte to the anode chambers 2*a*, and an anolyte discharging part 16 for discharging anolyte and vapor with reduced concentration. The ion exchange membrane electrolyzer 1 also includes cathode chamber side vapor-liquid separator parts 17 disposed on the respective cathode chambers 2*b*, a catholyte supply part 18 for supplying catholyte to the cathode chambers 2*b*, and a catholyte discharging part 19 for discharging catholyte and vapor with increased concentration.

As illustrated in FIG. 1 through FIG. 5, each of the electrolyzer units 2 includes a separation wall 4 that separates the anode chamber 2*a* from the cathode chamber 2*b*. The electrolyzer unit 2 also includes an anode 5 as a first electrode that is disposed on one side of the separation wall 4 with a space therefrom (on the right side in FIG. 1, FIG. 2 and FIG. 4, and on the lower side in FIG. 3 and FIG. 5), and a base part 6 that is disposed on the other side of the separation wall 4 with a space therefrom (on the left side in FIG. 1, FIG. 2 and FIG. 4, and on the upper side in FIG. 3 and FIG. 5).

The electrolyzer unit 2 further includes a cathode 7 as a second electrode that is disposed on the same side as the base part 6 but farther than the base part 6, and a plurality of elastic bodies 8 that are disposed between the base part and the cathode 7 in an elastically deformable manner. Further, the electrolyzer unit 2 includes a plurality of fixed bodies 9 for fixing the elastic bodies 8 to the base part 6.

The electrolyzer unit 2 includes annular sealing parts (e.g., gasket) 10, 10 that seal the ion exchange membranes 3. Further, the electrolyzer unit 2 includes anode holding parts 11 coupling the separation wall 4 with the anode 5 to hold the anode 5, base holding parts (or "second electrode holding part") 12 coupling the separation wall 4 with the base part 6 to hold the cathode 7, and seal supporting parts 13 coupled to the separation wall 4 to support the sealing part 10.

The ion exchange membrane 3 is disposed between adjacent ones of the electrolyzer units 2, 2, and thus between the anode 5 of one electrolyzer unit 2 and the cathode 7 of the other electrolyzer unit 2. Further, the ion exchange membrane 3 and the separation wall 4 separate the anode chamber 2*a* from the cathode chamber 2*b*.

By the elastic bodies 8 pressing on the cathode 7 against the ion exchange membrane 3, the ion exchange membrane 3 is brought into close contact with the anode 5 and the cathode 7. In this embodiment, an electrolytic pressure is different depending either on the side of the anode 5 or on the side of the cathode 7 (specifically, the pressure on the side of the cathode 7 is higher than the pressure on the side of the anode 5), and the ion exchange membrane 3 is also brought into close contact with the anode 5 by the pressure difference.

The anode 5 includes a conductive base material, and a catalytic layer coating a surface of the base material and having a catalytic function for chlorine generation. Specifically, the anode 5 is provided by first washing the conductive base material with an alkaline and organic solvent, performing a surface treatment, and then applying a mixed oxide having the catalytic function for chlorine generation. Further, the anode 5 is rigid.

A thickness of the anode 5 is preferably from 0.5 mm to 2.0 mm, in order to provide both of a mechanical strength and an economic performance. For example, if the anode 5 is thin, the mechanical strength is reduced, and the base material may deform when a surface treatment is performed, or the anode 5 may deform due to an electrolytic pressure produced during operation. As a result, a gap is produced between the ion exchange membrane 3 and the anode 5, and an electrolysis voltage becomes high. By contraries, if the anode 5 is thick, material costs increase, and the economic performance deteriorates.

Examples of the base material for the anode 5 include titanium and a titanium alloy. Further, examples of titanium and a titanium alloy include industrial pure titanium of grade 1, grade 2, grade 3, and grade 4 set by Japanese Industrial Standards (JIS standard), a titanium alloy whose corrosion resistance is improved by adding nickel, ruthenium, tantalum, palladium, tungsten, or the like, and a titanium alloy to which aluminum, vanadium, molybdenum, tin, iron, chromium, niobium, or the like, is added.

Specifically, as the base material for the anode 5, titanium expanded metal and titanium punching metal that are corrosion resistant are preferable, and titanium expanded metal is particularly preferable in view of the economic performance. Preferably, an aperture ratio of the base material of the anode 5 is from 25% to 75% in order to provide both of the mechanical strength and liquid permeability.

As a material of the catalytic layer of the anode 5, that is, as an electrode active material coating the surface of the base material, it is preferable to use a mixed oxide of a platinum-group metal such as iridium, ruthenium, platinum, and palladium, and one or more selected from a group including a valve metal such as titanium, tantalum, niobium, tungsten, and zirconium, and tin. Examples include iridium-ruthenium-titanium mixed oxide, iridium-ruthenium-platinum-titanium oxide, platinum oxide, and iridium oxide.

Examples of the surface treatment performed to the base material of the anode 5 include a mechanical surface treatment and a chemical surface treatment. Examples of the mechanical surface treatment include blasting using a fine abrasive material to make the surface of the base material concavo-convex in minute detail, and examples of the chemical surface treatment include chemical etching in a bath of oxalic acid, nitric acid, sulphuric acid, hydrochloric acid, hydrofluoric acid, or the like.

As the surface treatment, either of the chemical surface treatment and the mechanical surface treatment is performed singularly, or both of these may be combined. Preferably, a maximum difference in height between concavity and convexity formed over the surface of the anode 5 is from 3 μm to 50 μm, in order to provide both of liquid permeability and protection of the ion exchange membrane 3, and more preferably 5 μm to 40 μm.

The base part 6 is fixed with respect to and spaced from the anode 5 of an adjacent one of the electrolyzer units 2. Then, the ion exchange membrane 3, the cathode 7, and the elastic bodies 8 are interposed between the base part 6 and the anode 5 of the adjacent electrolyzer unit 2. Further, the base part 6 is rigid. It should be noted that in this embodiment, a cathode of a gap-type electrolyzer (electrolyzer having a gap between an ion exchange membrane and a cathode) is used as the base part 6.

Specifically, the ion exchange membrane electrolyzer 1 according to this embodiment is obtained by reconstructing a gap-type electrolyzer into a zero gap-type electrolyzer (electrolyzer in which an ion exchange membrane is brought into close contact with a cathode), by placing the cathode 7 and the elastic bodies 8 between the base part 6 that is used as a cathode of the gap-type electrolyzer and the ion exchange membrane 3. Therefore, the base part 6 is also referred to as a base cathode or a former cathode, and the cathode 7 is also referred to as an attached cathode or a new cathode.

A thickness of the base part 6 is preferably from 0.5 mm to 2.0 mm, in order to provide both of the mechanical strength and the economic performance. Further, the base part 6 includes a conductive base material. Examples of a material of the base material for the base part 6 include nickel, stainless, and copper. Specifically, as the base material for the base part 6, nickel expanded metal and nickel punching metal that are corrosion resistant are preferable. Here, an aperture ratio of the base material of the base part 6 is preferably from 25% to 75% in order to provide both of the mechanical strength and liquid permeability.

The cathode 7 is disposed between the base part 6 and the anode 5 of the adjacent electrolyzer unit 2. Further, the cathode 7 is pressed against the ion exchange membrane 3 by the elastic bodies 8 disposed between the cathode 7 and the base part 6. Then, the ion exchange membrane 3 is disposed between the cathode 7 and the anode 5 of the adjacent electrolyzer unit 2, and the ion exchange membrane 3 is held sandwiched between the cathode 7 and the anode 5. It should be noted that the cathode 7 is flexible or elastic.

The cathode 7 includes a conductive base material, and a catalytic layer coating a surface of the base material and having a catalytic function for hydrogen generation. A thickness of the cathode 7 is preferably from 0.01 mm to 0.5 mm, and a thickness of the catalytic layer is preferably from 1.0 μm to 20 μm.

Further, in view of the corrosion resistance and such, examples of the base material of the cathode 7 include nickel expanded metal, nickel punching metal, nickel fine mesh, and nickel plain mesh, and it is preferable to use nickel fine mesh or nickel plain mesh. Preferably, an aperture ratio of the base material of the cathode 7 is from 25% to 75%.

As illustrated in FIG. 2 through FIG. 7, each of the elastic bodies 8 includes a fixed part 81 fixed to the base part 6, and elastic parts 82 extending from the fixed part 81, and elastically deforming between the base part 6 and the cathode 7 to press on the cathode 7. Further, each of the elastic bodies 8 is conductive so as to electrically connect the base part 6 as the base cathode with the cathode 7.

In this embodiment, each of the elastic bodies 8 is configured such that the fixed part 81 and the elastic parts 82 are integrally formed by a base material in a plate shape. A thickness of the base material of the elastic bodies 8, that is, a thickness of the fixed part 81 and the elastic parts 82 is preferably from 0.02 mm to 0.3 mm, and particularly preferably from 0.1 mm to 0.20 mm. For example, as the elastic bodies 8, nickel, stainless, or copper alone may be used, or the base material may have a catalytic function for hydrogen generation by providing nickel plating, platinum plating, or platinum-group metal by firing.

In order to be fixed to the base part 6 by the fixed bodies 9, the fixed part 81 has a plurality of hole parts 81*a* in which the fixed bodies 9 are inserted respectively. Further, the fixed part 81 is formed in an elongated plate shape. Preferably, a crosswise dimension of the fixed part 81 in a crosswise direction (shorter-side direction) is from 3 mm to 30 mm.

Each of the elastic parts 82 includes base supporting parts 82*a* that are brought into contact with the base part 6 to support the base part 6 on one side, and cathode supporting parts (also referred to as "second electrode supporting parts") 82*b* that are brought into contact with the cathode 7 to support the cathode 7 on the other side. Further, the elastic parts 82 are formed so as to be plate-like, and then formed so as to be corrugated along a direction of extension from the fixed part 81 such that top parts on one side form the base supporting parts 82*a* and top parts on the other side form the cathode supporting parts 82*b*.

The plurality of elastic parts 82 extend from both sides of the fixed part 81 in the crosswise direction. Further, the plurality of elastic parts 82 is disposed in a line-symmetric manner along a longitudinal direction of the fixed part 81, specifically, with respect to a central line of the fixed part 81 in the crosswise direction. In addition, each of the base supporting parts 82*a* and the cathode supporting parts 82*b* as the top parts on one side and the other side of the elastic parts 82 is formed in a curved shape.

Here, a dimension of the elastic parts 82 in a longitudinal direction is preferably from 100 mm to 1400 mm, more preferably from 200 mm to 800 mm, a dimension of the elastic parts 82 in a shorter-side direction is preferably from 5 mm to 30 mm, and particularly preferably from 8 mm to 20 mm. Further, a distance between the base supporting parts 82*a* as the top parts on one side of each elastic part 82, and a distance between the cathode supporting parts 82*b*, 82*b* as the top parts on the other side of each elastic part 82 are preferably from 2 mm to 30 mm, and particularly preferably from 3 mm to 20 mm.

Moreover, a distance between the base supporting part 82*a* as the top part on one side of each elastic part 82 and the cathode supporting part 82*b* as the top part on the other side of the elastic part 82 is preferably from 1.0 mm to 6.0 mm in a restored state (not elastically deformed), and preferably from 0.5 mm to 3.0 mm in a state elastically deformed, and particularly preferably from 0.7 mm to 2.5 mm. Further, a pressure applied to the base part 6 and the cathode 7 by the elastically deformed elastic parts 82 is preferably from 3 kPa to 25 kPa, and particularly preferably from 7 kPa to 15 kPa.

Figure 8:
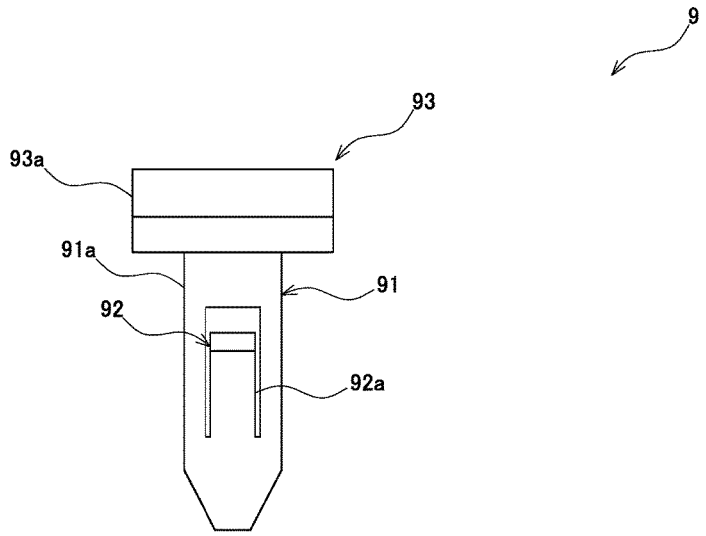
FIG. 8 is an overall side view of a fixed body according to this embodiment.
Figure 9:
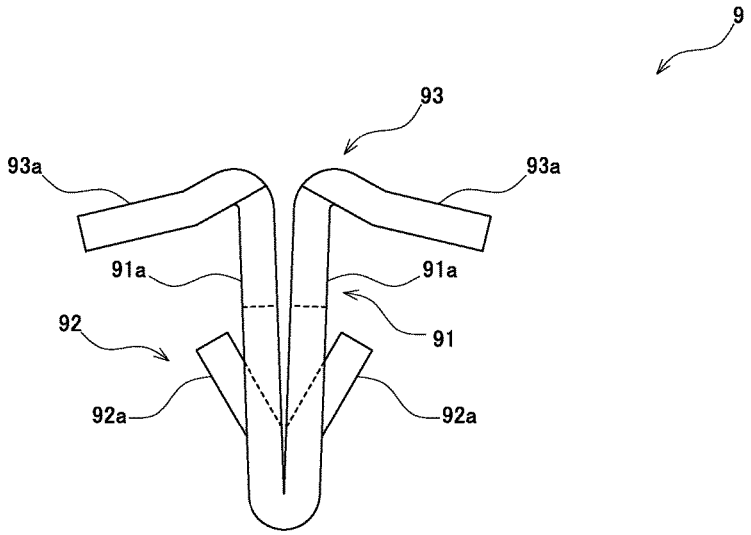
FIG. 9 is an overall side view of a fixed body according to this embodiment.

As illustrated in FIG. 2 through FIG. 5 and in FIG. 8 through FIG. 9, each of the fixed bodies 9 includes an insertion part 91 inserted into the base part 6 and the elastic body 8. Further, each of the fixed bodies 9 includes a base engagement part 92 disposed on one side of the insertion part 91 to be engaged with the base part 6, and an elastic body engagement part 93 disposed on the other side of the insertion part 91 to be engaged with the elastic body 8.

In this embodiment, each of the fixed bodies 9 is configured such that the insertion part 91, the base engagement part 92, and the elastic body engagement part 93 are integrally formed by a base material in a plate shape. A thickness of the base material of the fixed bodies 9, that is, a thickness of insertion pieces 91*a*, engagement pieces 92*a*, and engagement pieces 93*a* that will be later described is preferably from 0.05 mm to 0.5 mm.

The insertion part 91 includes a pair of insertion pieces 91*a*, 91*a* formed in an elongated plate shape. Further, each of the pair of insertion pieces 91*a*, 91*a* are coupled to each other on one end in a longitudinal direction. Here, each of the insertion pieces 91*a* has an opening for containing the base engagement part 92 (specifically, a base engagement pieces 92*a* that will be later described).

The base engagement part 92 includes a pair of base engagement pieces 92*a*, 92*a* formed in an elongated plate shape. Further, each of the base engagement pieces 92*a* is coupled to corresponding one of the insertion pieces 91*a* at a base end, and projects to a direction opposite of the insertion piece 91*a*. Moreover, the base engagement pieces 92*a* intersect respectively with the insertion pieces 91*a* at an angle, and are engaged with the base part 6 at a tip end. Here, each of the base engagement pieces 92*a* is elastically deformable such that the tip end moves toward and away from the insertion pieces 91*a* taking the base end as a base point.

The elastic body engagement part 93 includes a pair of elastic body engagement pieces 93*a*, 93*a* formed in a plate shape. Further, each of the elastic body engagement pieces 93*a* is coupled to the other end of corresponding one of the insertion pieces 91*a* at an end. Moreover, the elastic body engagement pieces 93*a* are engaged with the fixed part 81 of the elastic body 8 with one surface by elastically deforming.

Now, a method of fixing the base part 6 and the elastic body 8 according to this embodiment will be described with reference to FIG. 10 through FIG. 12.

Figure 10:
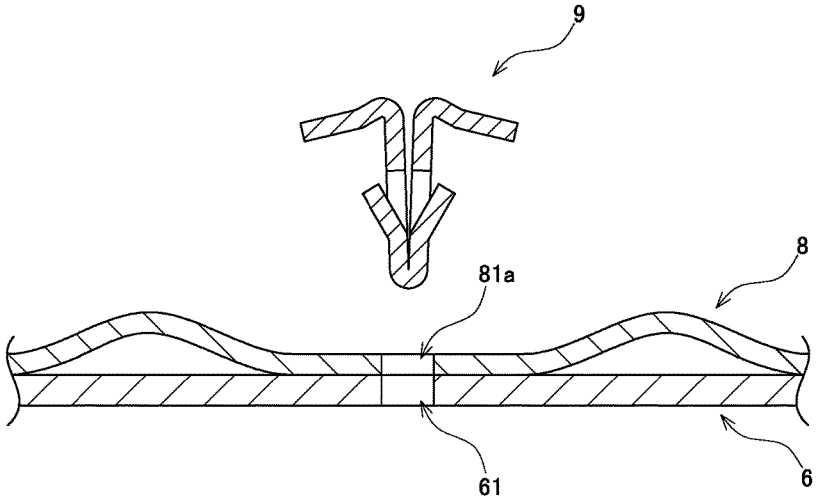
FIG. 10 is a sectional view of a main part illustrating how the elastic body according to this embodiment is fixed.
Figure 11:
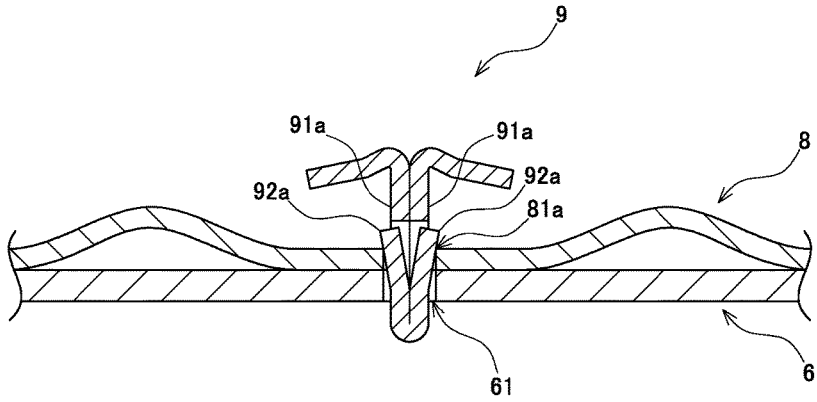
FIG. 11 is a sectional view of a main part illustrating how the elastic body according to this embodiment is fixed.

As illustrated in FIG. 10, the elastic body 8 is positioned with respect to the base part 6 such that a hole part 61 in the base part 6 and a hole part 81*a* in the fixed part 81 of the elastic body 8 communicate with each other. Then, as illustrated in FIG. 11, the insertion part 91 is inserted into the hole parts 61 and 81*a* from one end of the insertion part 91.

At this time, as a distance between the tip ends of the pair of base engagement pieces 92*a* is greater than a diameter of the hole parts 61 and 81*a*, the base engagement pieces 92*a* are brought into contact with inner edges of the hole parts 61 and 81*a* when passing the hole parts 61 and 81*a*. Therefore, the base engagement pieces 92*a* elastically deform taking the base end as the base point so that the tip ends move closer to the insertion pieces 91*a*.

Figure 12:
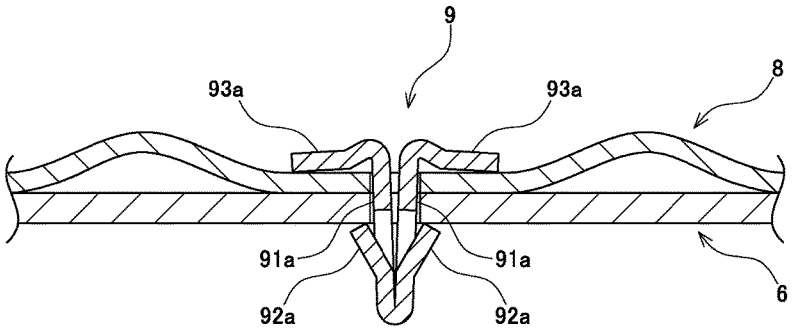
FIG. 12 is a sectional view of a main part illustrating how the elastic body according to this embodiment is fixed.

Then, as illustrated in FIG. 12, when the base engagement pieces 92*a* pass the hole part 61 in the base part 6, the base engagement pieces 92*a* that have been elastically deformed restore so that the tip ends move away from the insertion pieces 91*a*. With this, the base engagement pieces 92*a* are engaged with the base part 6 at the tip ends. Further, the elastic body engagement pieces 93*a* elastically deform so as to move away from the base engagement pieces 92*a*. With this, the elastic body engagement pieces 93*a* are engaged with the fixed part 81 of the elastic body 8 on one side. In this manner, the elastic body 8 is fixed to the base part 6 by the fixed bodies 9.

As described above, according to the ion exchange membrane electrolyzer 1 of this embodiment, each of the elastic bodies 8 disposed between the base part 6 and the cathode 7 is fixed to the base part 6 by the fixed bodies 9 at the fixed part 81. Further, the elastic parts 82 extending from the fixed part 81 are formed so as to be plate-like, and formed so as to be corrugated along direction in which it extends.

Moreover, the base supporting parts 82*a* as the top parts on one side of each elastic part 82 support the base part 6 by being brought into contact with the base part 6, and the cathode supporting parts 82*b* as the top parts on the other side of the elastic parts 82 support the cathode 7 by being brought into contact with the cathode 7. With this, as the elastically deforming elastic parts 82 press on the cathode 7, the ion exchange membrane 3 is brought into close contact respectively with the anode 5 and the cathode 7.

At this time, the elastic parts 82 formed so as to be corrugated are elastically deformed so as to flatten the corrugated shape by extending in the direction in which the elastic part extends according to the distance between the cathode 7 and the base part 6. Specifically, each of the elastic parts 82 elastically deforms such that the distance between the base supporting part 82*a* and the cathode supporting part 82*b* in the direction of extension increases, and such that the distance between the base supporting part 82*a* and the cathode supporting parts 82*b* in a direction perpendicular to the direction of extension (direction in which the cathode 7 faces the base part 6) decreases.

Therefore, as it is possible to prevent the elastic parts 82 from pressing on the cathode 7 locally, the electrodes 5 and 7 may be brought into close contact with the ion exchange membrane 3 by a generally uniform force. As a result, the electrodes 5 and 7 are brought into close contact with the ion exchange membrane 3 by a uniform force even when the ion exchange membrane electrolyzer 1 is used continuously, and thus it is possible to prevent the electrolysis voltage from increasing during the use.

Further, according to the ion exchange membrane electrolyzer 1 of this embodiment, the base supporting parts 82*a* as the top parts on one side of the elastic parts 82 in contact with the base part 6 and the cathode supporting parts 82*b* as the top parts on the other side of the elastic parts 82 in contact with the cathode 7 are formed in a curved shape. With this, the elastic parts 82 are able to elastically deform so as to easily extend in the direction of extension according to the distance between the cathode 7 and the base part 6. Therefore, the electrodes 5 and 7 may be brought into close contact with the ion exchange membrane 3 by a generally uniform force.

Further, according to the ion exchange membrane electrolyzer 1 of this embodiment, the plurality of elastic parts 82 are disposed so as to extend from the both sides of the fixed part 81 in the crosswise direction in a manner symmetrical with respect to the longitudinal direction of the fixed part 81. With this, the plurality of elastic parts 82 may be elastically deform uniformly when the elastic parts 82 elastically deform according to the distance between the cathode 7 and the base part 6. Therefore, the electrodes 5 and 7 may be brought into close contact with the ion exchange membrane 3 by a generally uniform force.

It should be noted that the present invention is not limited to the configuration of the above embodiment, nor to the effects described above. Further, it should be appreciated that the present invention may be modified in various manners without departing from the spirit and scope of the present invention. It should also be appreciated that, for example, any of configurations and methods according to various modified examples described below may be selected and applied to the configuration and the method according to the embodiment described above.

The elastic body 8 according to the embodiment is configured such that the both top parts of the elastic parts 82, that is, the base supporting parts 82*a* and the cathode supporting parts 82*b* are formed in a curved shape. However, the elastic body is not limited to such a configuration. For example, the elastic body may be configured such that at least one of the base supporting parts 82*a* as the top parts on one side of the elastic parts 82 and the cathode supporting parts 82*b* as the top parts on the other side may be formed in a curved shape, or may be formed in a planar shape as illustrated in FIG. 13 through FIG. 15.

Figure 13:
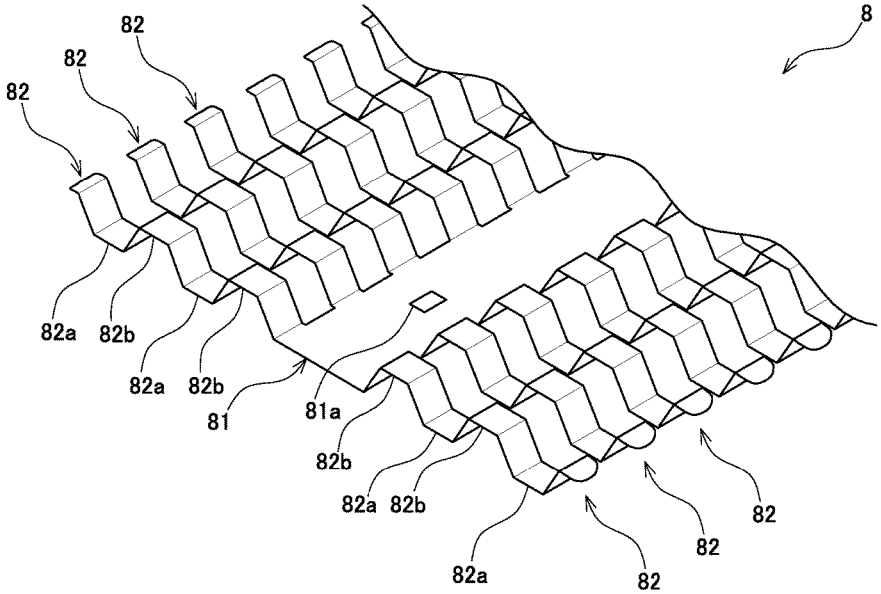
FIG. 13 is a perspective view of a main part of an elastic body according to another embodiment.

The elastic body 8 illustrated in FIG. 13 includes the base supporting parts 82*a* and the cathode supporting parts 82*b* formed in a planar shape. The elastic body 8 illustrated in FIG. 14 includes the base supporting parts 82*a* formed in a curved shape, and the cathode supporting parts 82*b* formed in a planar shape. The elastic body 8 illustrated in FIG. 15 includes the base supporting parts 82*a* formed in a planar shape, and the cathode supporting parts 82*b* formed in a curved shape.

Figure 14:
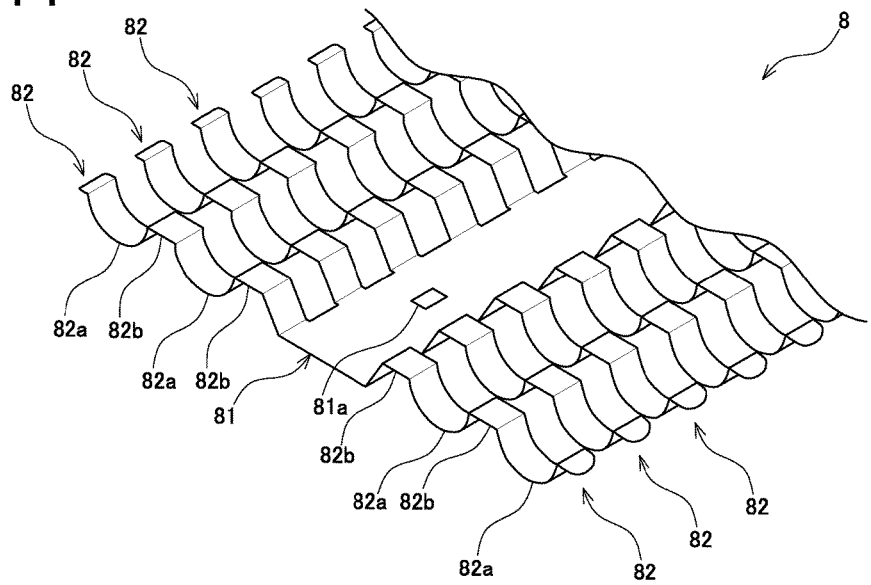
FIG. 14 is a perspective view of a main part of an elastic body according to yet another embodiment.
Figure 15:
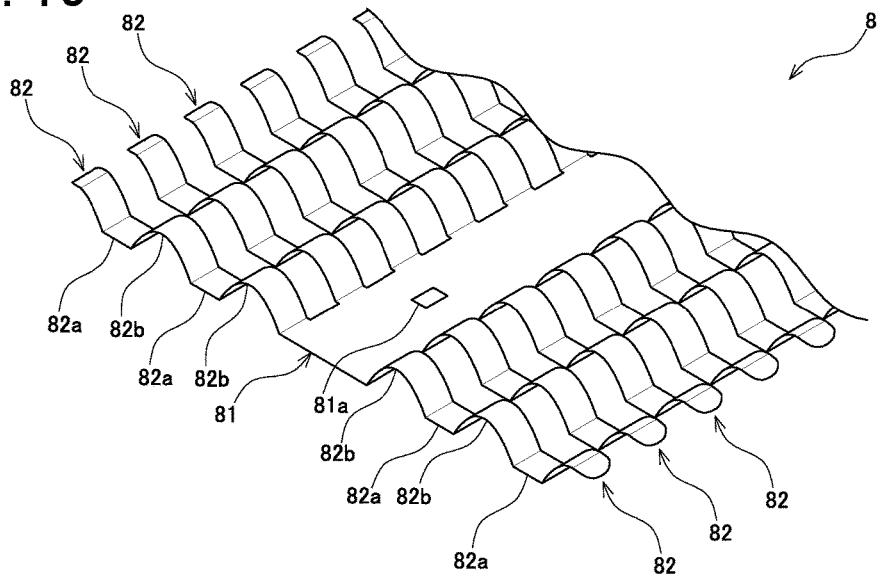
FIG. 15 is a perspective view of a main part of an elastic body according to yet another embodiment.

According to the configurations illustrated in FIG. 13 through FIG. 15, the base supporting parts 82*a* as the top parts on one side of the elastic parts 82 in contact with the base part 6, and (or) the cathode supporting parts 82*b* as the top parts on the other side of the elastic parts 82 in contact with the cathode 7 are (is) formed in a planar shape. With this, the elastic parts 82 may be brought into contact with the base part 6 and (or) the cathode 7 with a uniform force by the supporting parts 82*a*, 82*b* formed in a planar shape. Therefore, the electrodes 5 and 7 may be brought into close contact with the ion exchange membrane 3 by a generally uniform force.

Further, the elastic body 8 according to the embodiment is configured such that the plurality of elastic parts 82 are disposed so as to extend from the both sides of the fixed part 81 in the crosswise direction, and in a manner symmetrical with respect to the longitudinal direction of the fixed part 81. However, the elastic body is not limited to such a configuration. For example, the elastic body may be configured such that the elastic parts 82 are disposed so as to extend from one side of the fixed part 81 in the crosswise direction.

Figure 16:
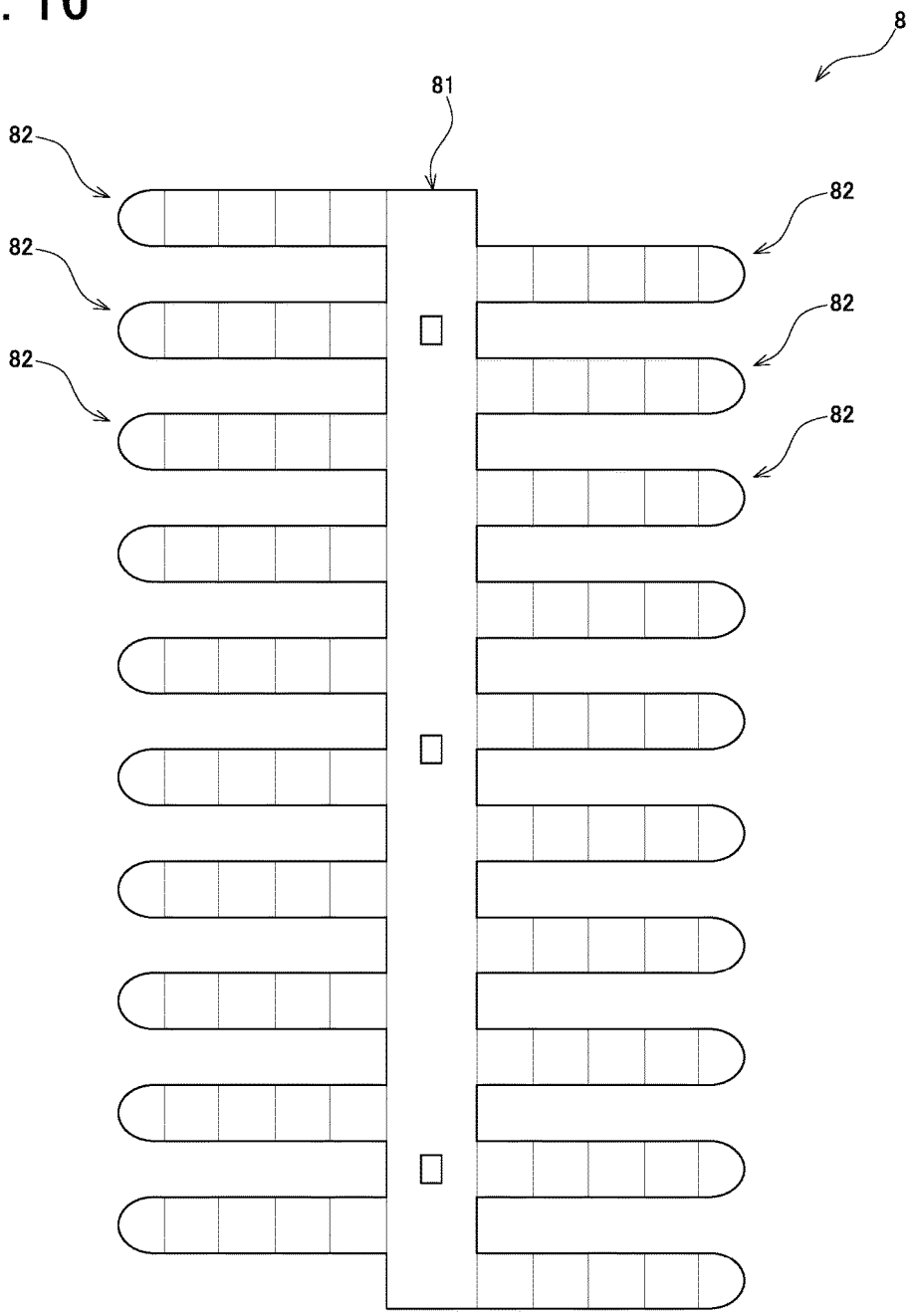
FIG. 16 is an overall front view of an elastic body according to yet another embodiment.

Moreover, the elastic body may be configured as illustrated in FIG. 16, for example, such that the plurality of elastic parts 82 are disposed so as to extend from the both sides of the fixed part 81 in the crosswise direction, and in a manner asymmetrical with respect to the longitudinal direction of the fixed part 81. According to the elastic body 8 illustrated in FIG. 16, the plurality of elastic parts 82 are disposed so as not to overlap each other across the fixed part 81 in the crosswise direction, and in a point-symmetric manner with respect to a center (center point) of the fixed part 81 in the longitudinal direction and the crosswise direction.

Further, the elastic body 8 according to the embodiment is configured such that the fixed part 81 is fixed to the base part 6. However, the elastic body is not limited to such a configuration. For example, the elastic body may be configured such that the fixed part 81 is fixed to the second electrode, specifically, the cathode 7.

Moreover, the ion exchange membrane electrolyzer 1 according to the embodiment is configured such that the elastic body 8 is fixed to the base part 6 by the fixed bodies 9. However, the ion exchange membrane electrolyzer is not limited to such a configuration. For example, the ion exchange membrane electrolyzer may be configured such that the elastic body 8 is fixed to the base part 6 by welding.

Further, for example, the elastic body 8 may be configured to include a projecting part projecting from the fixed part 81, and configured such that the projecting part includes an insertion part inserted into the base part 6, and a base engagement part engaged with the base part 6. Here, the insertion part and the base engagement part of this projecting part may be sufficient if provided with functions similar to those of the insertion part 91 and the base engagement part 92 according to the above embodiment.

Moreover, the ion exchange membrane electrolyzer 1 according to the embodiment is configured such that the electrolyzer unit 2 is a bipolar-type electrolyzer unit having the anode chamber 2*a* and the cathode chamber 2*b*. However, the ion exchange membrane electrolyzer is not limited to such a configuration. For example, the ion exchange membrane electrolyzer may be configured such that the electrolyzer unit 2 is a monopolar-type electrolyzer unit having only the anode chamber 2*a* (or the cathode chamber 2*b*).

Further, the ion exchange membrane electrolyzer 1 according to the embodiment is configured such that the second electrode pressed against the ion exchange membrane 3 by the elastic bodies 8 disposed between the second electrode and the base part 6 is the cathode 7. However, the ion exchange membrane electrolyzer is not limited to such a configuration. For example, the ion exchange membrane electrolyzer may be configured such that the second electrode pressed against the ion exchange membrane 3 by the elastic bodies 8 disposed between the second electrode and the base part 6 is anode.

Moreover, the ion exchange membrane electrolyzer 1 according to the embodiment is configured such that a gap-type electrolyzer is reconstructed into a zero gap-type electrolyzer by providing the cathode 7 and the elastic bodies 8 between the base part 6 used as a cathode of the gap-type electrolyzer and the ion exchange membrane 3. However, the ion exchange membrane electrolyzer is not limited to such a configuration. For example, the ion exchange membrane electrolyzer may be configured such that a zero gap-type electrolyzer is newly manufactured, that is, the base part 6 is not provided with a function of an electrode.

DESCRIPTION OF REFERENCE SIGNS

1: ion exchange membrane electrolyzer
2: electrolyzer unit
2*a*: anode chamber
2*b*: cathode chamber
3: ion exchange membrane
4: separation wall
5: anode (first electrode)
6: base part
7: cathode (second electrode)
8: elastic body
9: fixed body
10: sealing part
11: anode holding part
12: base holding part (second electrode holding part)
13: seal supporting part
14: anode chamber side vapor-liquid separator part
15: anolyte supply part
16: anolyte discharging part
17: cathode chamber side vapor-liquid separator part
18: catholyte supply part
19: catholyte discharging part
61: hole part
81: fixed part
81*a*: hole part
82: elastic part
82*a*: base supporting part
82*b*: cathode supporting part (second electrode supporting part)
91: insertion part
91*a*: insertion piece
92: base engagement part
92*a*: base engagement piece
93: elastic body engagement part
93*a*: elastic body engagement piece

What is claimed is:

1. An ion exchange membrane electrolyzer, comprising:
a first electrode;
a base part fixed with respect to and spaced from the first electrode;
a second electrode disposed between the first electrode and the base part;
an ion exchange membrane disposed between the first electrode and the second electrode; and
an elastic body disposed between the base part and the second electrode in an elastically deformable manner, and configured to press on the second electrode so as to bring the ion exchange membrane into close contact with the electrodes, wherein
the elastic body includes: an elongate-shaped fixed part extending in a longitudinal direction and having two longitudinal outer sides, said fixed part being fixed to one of the base part and the second electrode; and a plurality of elastic parts, wherein a first group of the plurality of elastic parts are attached to a first of said two sides and extend in a cross-wise direction beyond said first side, and a second group of the plurality of elastic parts are attached to a second of said two sides and extend in a cross-wise direction beyond said second side, and wherein each of the plurality of elastic parts is configured to press on the other of the base part and the second electrode by elastic deformation, and
each of the plurality of elastic parts is formed so as to be corrugated along a direction in which it extends, such that a crest part on a first side of said elastic part is in contact with the base part and a trough part on a second side of said elastic part is in contact with the second electrode.

2. The ion exchange membrane electrolyzer according to claim 1, wherein
at least one of the crest part on the first side or the trough part on the second side of each of the plurality of elastic parts is formed in a curved shape.

3. The ion exchange membrane electrolyzer according to claim 1, wherein at least one of the crest part on the first side or the trough part on the second side of each of the plurality of elastic parts is formed in a planar shape.

4. An elastic body comprising:

an elongate-shaped fixed part extending in a longitudinal direction and having two longitudinal outer sides; and a plurality of elastic parts, wherein a first group of the plurality of elastic parts are attached to a first of said two sides and extend in a cross-wise direction beyond said first side, and a second group of the plurality of elastic parts are attached to a second of said two sides and extend in a cross-wise direction beyond said second side, and wherein each of the plurality of elastic parts is configured to press on either a base part or a second electrode by elastic deformation, wherein:

the elastic body is configured to be disposed in an elastically deformable manner between the base part, which is fixed with respect to and spaced from a first electrode, and the second electrode, which is disposed between the first electrode and the base part, and wherein each of the plurality of elastic parts is formed so as to be corrugated along a direction in which it extends, such that a crest part is formed on a first side of each of the plurality of elastic parts and a trough part is formed on a second side of each of the plurality of elastic parts.

5. The elastic body according to claim 4, wherein at least one of the crest part on the first side or the trough part on the second side of each of the plurality of elastic parts is formed in a curved shape.

6. The elastic body according to claim 4, wherein at least one of the crest part on the first side or the trough part on the second side of each of the plurality of elastic parts is formed in a planar shape.

* * * * *